US007401571B1

(12) United States Patent
Creed

(10) Patent No.: US 7,401,571 B1
(45) Date of Patent: Jul. 22, 2008

(54) GUTTER SYSTEM INDICATOR FOR INDICATING A CLOGGED OR PARTIALLY CLOGGED CONDITION

(76) Inventor: Tony William Creed, 10241 NC 211 Hwy., Aberdeen, NC (US) 28316

( * ) Notice: Subject to any disclaimer, the term of this patent is extended or adjusted under 35 U.S.C. 154(b) by 412 days.

(21) Appl. No.: 10/970,629

(22) Filed: Oct. 21, 2004

(51) Int. Cl.
*G01F 23/20* (2006.01)

(52) U.S. Cl. ..... 116/228; 340/612; 340/623; 73/309

(58) Field of Classification Search ..... None
See application file for complete search history.

(56) References Cited

U.S. PATENT DOCUMENTS 3,483,656 A * 12/1969 Baumann ..... 47/59 R
3,918,034 A * 11/1975 Orth, Jr. ..... 340/539.26
3,926,143 A * 12/1975 Hothan ..... 116/228
3,988,857 A * 11/1976 Baumann ..... 47/59 R
5,550,532 A * 8/1996 Marshall ..... 340/604
6,273,021 B1 * 8/2001 Pembroke ..... 116/228
6,786,091 B1 * 9/2004 Aleali ..... 73/309
6,804,911 B1 * 10/2004 Henke ..... 43/100

* cited by examiner

*Primary Examiner*—Benjamin C. Lee
*Assistant Examiner*—Son Tang
(74) *Attorney, Agent, or Firm*—Coats & Bennett, P.L.L.C.

(57) ABSTRACT

A gutter system includes an indicator for indicating that the gutter system is clogged or partially clogged. The indicator includes a floating device such as a ball. There is provided a retainer that retains the ball within the gutter system and in the vicinity of a downspout and downspout opening that forms a part of a gutter system. The retainer comprises a housing of an open construction and includes a bottom, sidewall structure and a top portion. Since the housing is an open construction, water passing through the gutter can normally flow through the housing. When the gutter system is clear and does not have any substantial obstructions, it follows that the water accumulation within the gutter will be relatively small. However, when the gutter system is clogged or partially clogged, then there will be some accumulation of water in the gutter system. When there is accumulation of water, the floating device will float to an upper elevated position where the same can be seen from ground level. This indicates a clogged or partially clogged gutter system.

26 Claims, 2 Drawing Sheets

GUTTER SYSTEM INDICATOR FOR INDICATING A CLOGGED OR PARTIALLY CLOGGED CONDITION

FIELD OF THE INVENTION

The present invention relates to gutters and gutter systems, and more particularly to an indicator for use in conjunction with a gutter system that indicates when the gutter system is clogged or partially clogged.

BACKGROUND OF THE INVENTION

Gutters are used around eves of houses and other buildings to catch and channel water, and generally to control drainage around the exterior of such buildings. As every homeowner knows, gutter systems, while important, are difficult to maintain operational and clean. Often homes and buildings are disposed adjacent or underlie trees that shed debris such as leaves and pine needles. These leaves and pine needles and other debris often end up in the gutters and downspouts causing them to be clogged and non-functional.

It is difficult to determine if a gutter system or a portion thereof is clogged and non-functional. In many cases, gutters are mounted around the upper story of two story buildings and consequently they are hard to gain access to. About the only way to inspect a second story gutter, for example, is by utilizing a ladder and that is often time consuming and again, difficult and even dangerous for older people.

There has been and continues to be a need for an indicator that will indicate to the homeowner that a portion of the gutter system or downspout is clogged or partially clogged and needs cleaning.

SUMMARY OF THE INVENTION

The present invention relates to a gutter system having a gutter and an indicator associated with the gutter system for indicating that the gutter system, including the gutter and the downspout, is clogged or partially clogged. In the case of one embodiment, the indicator includes a floating device that is disposed within the gutter and wherein the floating device floats in accumulated water in the gutter. A retainer is provided for retaining the floating device. When the gutter system becomes clogged or partially clogged, the floating device will float in the accumulated water in the gutter and will indicate a clogged or partially clogged gutter system.

In one particular embodiment, the retainer includes a housing having an open construction. Confined within the housing is a floating device such as a ball. The housing structure includes a bottom, sidewall structure and a top. Normally when the gutter system is unclogged, the floating device or ball rests on the bottom of the housing out of view. However, in the event of a clogged or partially clogged downspout or gutter trough, water will accumulate in or around the housing causing the floating device to float and assume an elevated position where at least the top portion of the floating device can be viewed. This indicates a clogged or partially clogged gutter system.

Further, the present invention entails an indicator for use in conjunction with a gutter system. The indicator includes a floating device and a retainer for retaining the floating device about the gutter. The retainer is adapted to be secured or retained about the gutter system. The floating device is normally positioned within a gutter or gutter trough that forms a part of the gutter system. When the gutter system is unclogged, water will freely move through the gutter system and pass through the retainer and floating device. However, when the gutter system or any component thereof becomes clogged or partially clogged, then the gutter system will accumulate water and the floating device will float in the accumulated water and raise to a level where the floating device indicates that a component of the gutter system is clogged or partially clogged.

In addition, the present invention entails a method of providing a visual indication that a gutter system is clogged or at least partially clogged. The method entails placing a floating device in the gutter or gutter trough that forms a part of the gutter system. Next the method entails retaining the floating device within the gutter. When the gutter trough or gutter downspout becomes clogged or partially clogged, the gutter trough will accumulate water and in response to the accumulation of water, the floating device will float in the water. As the water continues to accumulate the elevation of the floating device will rise and eventually the floating device will rise to a level where it can be seen from a distance. This indicates that the gutter system is clogged or partially clogged.

Other objects and advantages of the present invention will become apparent and obvious from a study of the following description and the accompanying drawings which are merely illustrative of such invention.

DESCRIPTION OF THE INVENTION

Figure 1:
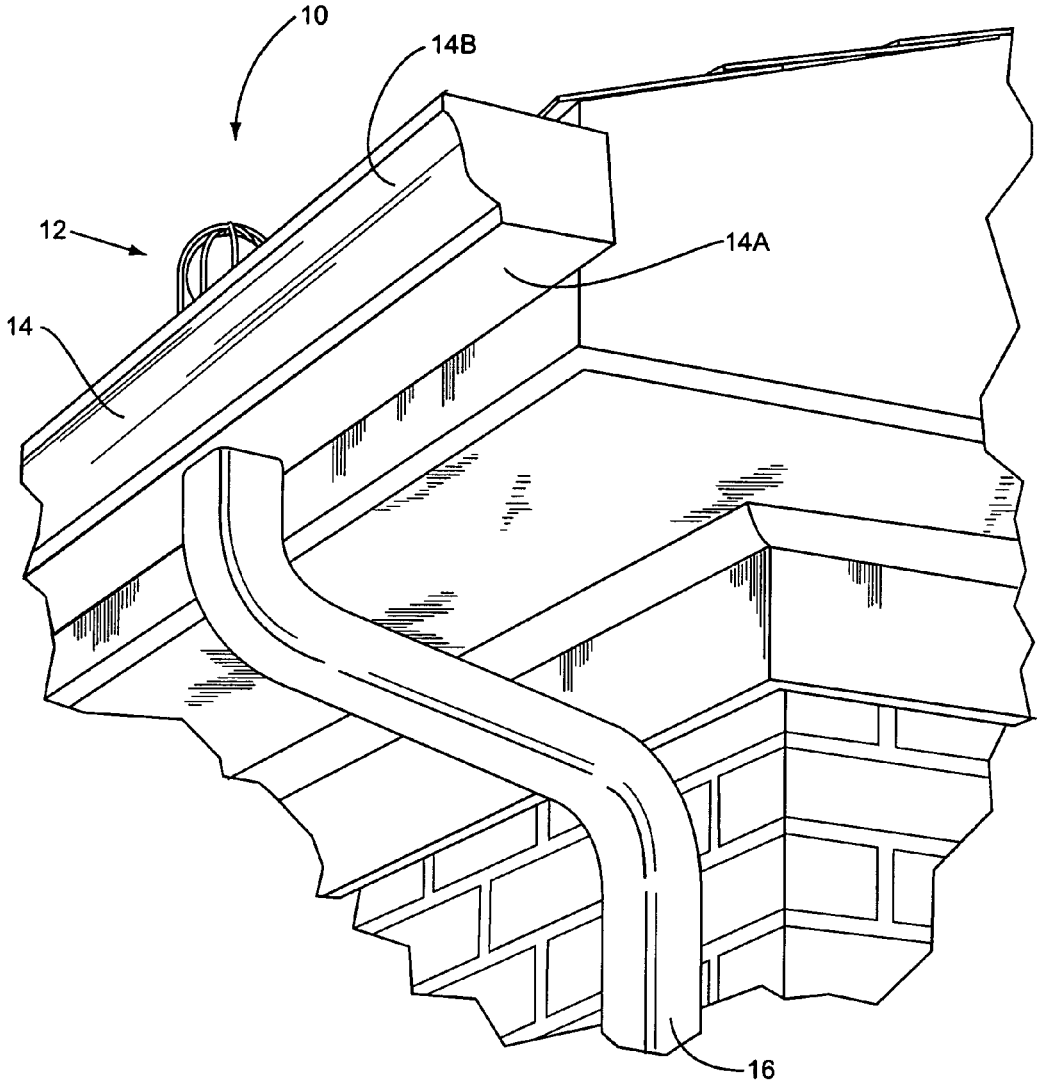
FIG. 1 is a fragmentary perspective view illustrating the gutter system of the present invention.

With further reference to the drawings, the gutter system of the present invention is shown therein and indicated generally by the numeral 10. Components of the gutter system 10 will be discussed subsequently herein. Associated with the gutter system 10 is an indicator indicated generally by the numeral 12. As will be appreciated from subsequent portions of this disclosure, indicator 12 functions to provide a visual indication that the gutter system 10 is either clogged or partially clogged. In particular, the indicator 10 is of the floating type. As will be discussed, the indicator 12 includes a floating device such as a ball that is retained within a portion of the gutter system 10. When the gutter system 10 becomes clogged or partially clogged, there will be an accumulation of water in the gutter system. When the water accumulates in the gutter system, the floating device will float in the accumulated water. As the water continues to accumulate and rise within the gutter system 10, the floating device will rise with the level of the accumulated water and eventually will rise to a level where the floating device will indicate that the gutter system 10 is experiencing a clogging condition.

Turning to a discussion of the gutter system 10, the structure of the gutter system 10 is conventional. In that regard the gutter system 10 includes a gutter or gutter trough 14 that extends generally horizontal across a building structure such as a fascia board. Gutter 14 include a bottom 14A and a pair of opposed sides 14B. In conventional fashion, one or more downspout openings 14C would be provided in the bottom 14B of the gutter 14. Ordinarily, the downspout opening 14C is spaced inwardly from an end of the gutter system. Consequently the bottom 14B of the gutter 14 is typically sloped to channel water from opposite end portions towards the downspout opening 14C. Extending from the downspout opening 14C is a downspout 16. Consequently it is appreciated that in normal operations, rainwater impacting the roof of a structure will be directed downwardly into the gutter 14 and from the gutter 14 the water will run to the downspout opening 14C where the water then enters the downspout 16 and is directed away from the gutter system 10.

Now turning to the indicator 12, as noted above, the indicator 12 includes a floating device 18. In the case of the embodiment illustrated herein, the floating device 18 is in the form of a ball. It should be appreciated that other floating devices could be utilized.

Floating device 18 is intended to be confined within the gutter 14. That is, in normal operations, the floating device will rest in the gutter 14 and generally not be viewed from a distance. However, as will be appreciated from further discussions, once the gutter system 10 becomes clogged or partially clogged, the floating device or ball will rise in the accumulated water within the gutter 14 and at least a top portion of the floating device will be visible from a distance.

Figure 2:
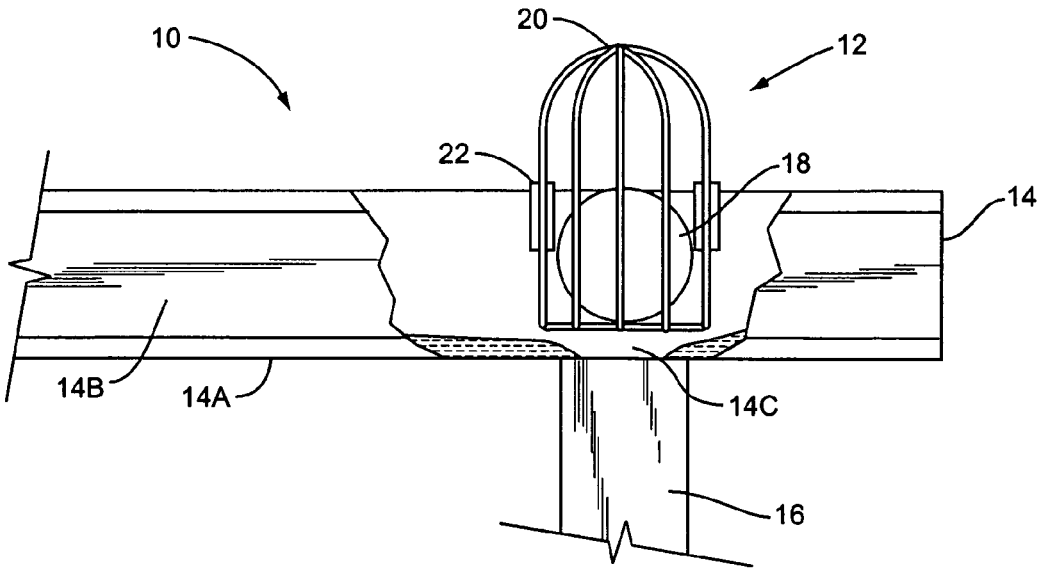
FIG. 2 is a fragmentary front elevational view of the gutter system showing the indicator in a lower position.
Figure 3:
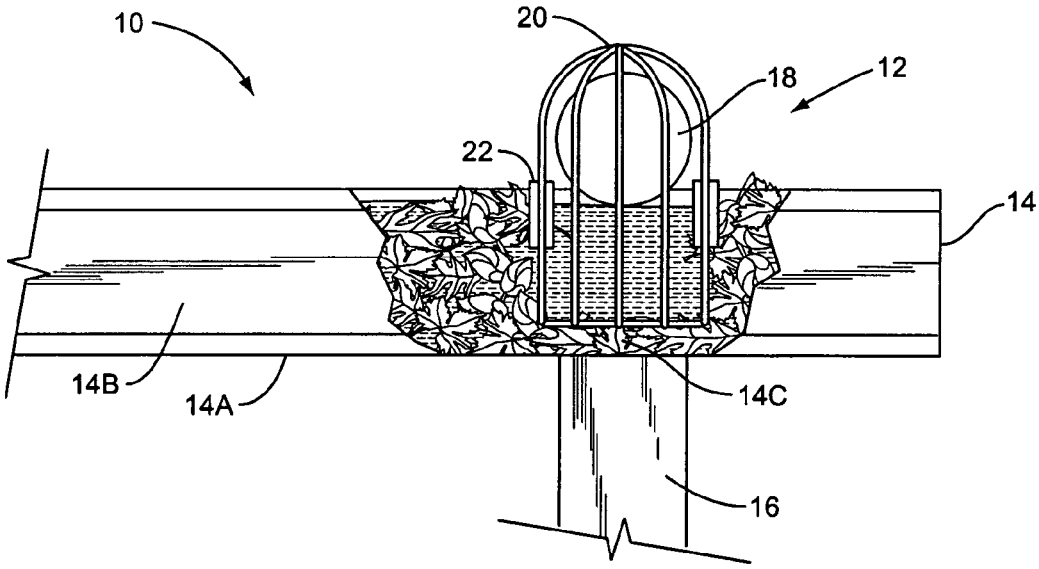
FIG. 3 is a view similar to FIG. 2 except in FIG. 3 the gutter system is clogged or partially clogged and the indicator indicates that the gutter system is clogged or partially clogged.

To confine the floating device 18 within the gutter 14, the indicator includes a retainer. The retainer is designed to maintain the floating device or ball within the gutter system 10. Further, the retainer positions the floating device in a particular location within the gutter. The retainer in the embodiment illustrated herein includes a housing. The housing is of an open construction. This permits water to flow through and pass the housing. As seen in FIGS. 2 and 3, the floating device 18 is n the form of the floating ball is confined or retained within the housing. As will be appreciated from further discussion, the housing that forms the retainer is fixed with respect to the gutter 14. Consequently, the movement of the floating device 18 within the housing is limited.

In the case of the embodiment illustrated herein, the housing that forms the retainer is in the form of a cage 20. Cage 20 includes a bottom, a sidewall structure, and a top portion. Cage 20 can be made of various materials including copper, stainless steel or other attractive materials. As seen in FIGS. 1-3, cage 20 is of an open construction and in the case of this embodiment includes a plurality of moderately rigid wire type members that are welded or otherwise secured to form the cage. In this embodiment, as illustrated in FIGS. 2 and 3, cage 20 is generally elongated and extends upwardly from the gutter 14 to where an upper portion of the cage extends above the level of the gutter 14.

Cage 20 and floating device 18 confined therein can be positioned at various locations in the gutter system 10. However, in one embodiment it is contemplated that the cage 20 and the floating device 18 can be placed in the vicinity of the downspout opening 14C. There are a number of reasons that this may be an appropriate place to position the cage. While clogging can occur in the gutter trough 14, it is common to find clogging in the downspout 16. When clogging occurs in the downspout 16, then water will tend to accumulate throughout the gutter system 10, but may accumulate more above the downspout opening 14C. Consequently, in the particular embodiment illustrated herein, cage 20 and floating device 18 are positioned directly over the downspout opening 14C.

Various means can be utilized to secure the cage 20 to the gutter system 10. In the embodiment illustrated herein there is provided one or more fasteners 22 that are fixed to the gutter 14 and which extend therefrom and connect to the cage 20. In the embodiment illustrated in FIGS. 2 and 3, cage 20 is suspended by the fasteners 22 above the downspout opening 14C. As illustrated in FIG. 3, the bottom of cage 20 lies directly over the downspout opening 14C but is spaced slightly above the bottom 14A of the gutter 14.

Because of the open construction of the cage 20 and its particular position with respect to the downspout 16, it is seen in FIG. 3 that the cage can assist in retaining and filtering debris and preventing the debris from entering the downspout opening 14C and the downspout 16. This is an additional advantage of the indicator 12 of the present invention.

In any event, when there is a clogged or partially clogged downspout 16, water will tend to accumulate or back-up in the area of the gutter 14 overlying the downspout opening 14C. When water accumulates in this area, the floating device 18 will tend to float in the accumulated water that extends through the open constructed cage 20. Thus the floating device will move upwardly from the lower position shown in FIG. 2. As the water moves up the floating device will also move up to an elevated position. An example of this is shown in FIG. 3. Note in this position that the floating device or ball 18 is elevated to a height above the top of a gutter 14. This permits a homeowner or maintenance person to view the floating device or ball 18 from a distance. When the floating device or ball 18 is seen elevated above the top of the gutter 14, then this is an indication that the gutter system is clogged or partially clogged. In this particular instance, this is an indication that the downspout is clogged. Of course, once a homeowner or maintenance person views the floating device 18 in an elevated position, such as shown in FIG. 3, he or she knows that there is a clogged or partially clogged condition in the gutter system 10 and that some parts of the gutter system 10 need to be cleaned.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A gutter system comprising:

a. an elongated gutter;

b. an indicator associated with the gutter system for indicating that the gutter is clogged or at least partially clogged;

c. the indicator including a floating device that normally is disposed within the gutter and wherein the floating device floats when water accumulates in the gutter;

d. a retainer for retaining the floating device;

e. the retainer including a cage and wherein the floating device is confined within the cage, and wherein the cage permits water to flow through the cage; and f. wherein when the gutter system becomes clogged or partially clogged, the floating device will float in water accumulated in the gutter visibility indicating a clogged or partially clogged gutter system.

2. The gutter system of claim 1 wherein the floating device comprises a ball.

3. The gutter system of claim 1 wherein the cage includes a bottom, a side structure, and a top.

4. The gutter system of claim 3 wherein the floating device comprises a ball that is disposed within the cage.

5. The gutter system of claim 1 wherein the gutter system includes a downspout opening and wherein the floating device is retained in the vicinity of the downspout opening.

6. The gutter system of claim 1 wherein the gutter system includes a downspout opening and wherein the cage is disposed over the downspout opening.

7. The gutter system of claim 1 wherein the cage is of an open wire construction.

8. The gutter system of claim 7 wherein the cage includes a side area and wherein substantially the entirety of the side area is of an open wire construction.

9. The gutter system of claim 1 wherein the cage is more open than closed.

10. An indicator for use in conjunction with a gutter system having a gutter, comprising:

a. a floating device;

b. a cage having the floating device disposed therein, and wherein the cage permits water to flow through the cage;

c. the cage adapted to be secured about the gutter; and d. wherein the floating device is movable while being retained by the cage between a lowered position within the gutter to an elevated position wherein in the elevated position the floating device floats in accumulated water thereby visibly indicating that the gutter is clogged or partially clogged.

11. The indicator of claim 10 wherein the gutter system includes a downspout opening and wherein the cage is adapted to retain the floating device in the vicinity of the downspout opening.

12. The indicator of claim 11 wherein the cage retains the floating device over the downspout opening.

13. The indicator of claim 10 wherein the floating device comprises a ball.

14. The indicator of claim 10 wherein the cage includes a bottom, a side structure and a top.

15. The indicator of claim 14 wherein the floating device comprises a ball that is disposed within the cage.

16. The indicator of claim 10 including at least one fastener for securing the cage to the gutter.

17. The indicator of claim 10 including at least one fastener for securing the housing adjacent the downspout opening.

18. The indicator of claim 10 wherein the cage is of an open wire construction.

19. The indicator of claim 18 wherein the cage includes a side area and wherein substantially the entirety of the side area is of an open wire construction.

20. The indicator of claim 19 wherein the cage is more open than closed.

21. A method of providing a visual indication that a gutter or downspout is clogged or partially clogged comprising:

a. placing a floating device in the gutter;

b. retaining the floating device within a cage disposed within the gutter and permitting water to flow through the cage; and c. wherein when the gutter or downspout becomes clogged or partially clogged the gutter accumulate water and in response the floating device floats in the water and be elevated to a position visibly indicating a clogged or partially clogged gutter or downspout.

22. The method of claim 21 including placing the cage and floating device in the vicinity of the downspout opening formed in the gutter.

23. The method of claim 22 including placing the cage and floating device over the downspout opening.

24. The method of claim 21 wherein the cage is of an open wire construction and includes a side area and wherein substantially the entirety of the side area is of an open wire construction.

25. A gutter system comprising:

a. an elongated gutter;

b. a retainer of an open construction disposed in the gutter, and wherein the open construction permits water to flow through the retainer;

c. a floating indicator confined within the retainer and visible through the retainer, and wherein the floating indicator is moveable vertically in the retainer from a lower position to an upper position in response to the gutter being clogged or partially clogged; and d. the floating indicator always being disposed within the retainer, and wherein the floating indicator floats in water accumulated in the gutter, thereby indicating a clogged or partially clogged gutter system.

26. The gutter system of claim 25 wherein the retainer includes a cage and wherein the floating indicator is always confined and movable vertically in the cage.

* * * * *